US009217336B2

(12) United States Patent
Nielson et al.

(10) Patent No.: US 9,217,336 B2
(45) Date of Patent: Dec. 22, 2015

(54) GAS TURBINE ENGINE LUBRICATION FLUID BARRIER

(75) Inventors: Engward Nielson, El Cajon, CA (US); Michael Fox, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 913 days.

(21) Appl. No.: 13/398,167

(22) Filed: Feb. 16, 2012

(65) Prior Publication Data

US 2013/0214492 A1 Aug. 22, 2013

(51) Int. Cl.
*F01D 25/18* (2006.01)

(52) U.S. Cl.
CPC ..... *F01D 25/186* (2013.01); *Y10T 29/49229* (2015.01)

(58) Field of Classification Search
CPC ..... F01D 25/183; F01D 25/28; F01D 25/283; F01D 11/003; F01D 11/02; F01D 11/04; F01D 25/186; F05D 2240/70; F16N 2031/025; F16J 15/002; F16J 15/164; F16J 15/4472; F16J 15/54
USPC ..... 415/110, 111, 112, 174.5, 230; 277/409, 411, 412, 423, 427, 430, 431
See application file for complete search history.

(56) References Cited

U.S. PATENT DOCUMENTS

| | | | | |
|---|---|---|---|---|
| 1,720,696 | A | 7/1929 | Simpson | |
| 2,274,836 | A | 3/1942 | Koster | |
| 2,681,837 | A * | 6/1954 | Boyd et al. | 384/466 |
| 3,004,782 | A * | 10/1961 | Meermans | 277/347 |
| 3,468,548 | A | 9/1969 | Webb et al. | |
| 3,617,068 | A | 11/1971 | Sprenger | |
| 4,084,825 | A | 4/1978 | Ludwig | |
| 4,531,746 | A | 7/1985 | Amdall et al. | |
| 4,645,213 | A | 2/1987 | Washimi et al. | |
| 5,236,302 | A | 8/1993 | Weisberger et al. | |
| 5,272,868 | A * | 12/1993 | Ciokajlo et al. | 60/39.08 |
| 5,322,298 | A | 6/1994 | Maier | |
| 5,503,407 | A | 4/1996 | McNickle | |
| 5,630,590 | A | 5/1997 | Bouchard et al. | |
| 5,639,212 | A | 6/1997 | Schaefer et al. | |
| 5,961,279 | A | 10/1999 | Ingistov | |
| 6,330,790 | B1 * | 12/2001 | Arora et al. | 60/39.08 |
| 6,412,270 | B1 | 7/2002 | Mortzheim et al. | |
| 6,675,584 | B1 | 1/2004 | Hollis et al. | |
| 7,004,475 | B2 | 2/2006 | McHale et al. | |
| 7,059,827 | B1 | 6/2006 | Ingistov | |
| 7,296,415 | B2 | 11/2007 | Coulon et al. | |
| 7,363,762 | B2 | 4/2008 | Montgomery et al. | |
| 7,836,591 | B2 | 11/2010 | Allen et al. | |
| 8,066,475 | B2 | 11/2011 | Bulgrin et al. | |
| 2002/0074730 | A1 * | 6/2002 | Mayer et al. | 277/355 |

(Continued)

FOREIGN PATENT DOCUMENTS

| | | |
|---|---|---|
| JP | 11-50994 | 2/1999 |

*Primary Examiner* — Craig Kim
*Assistant Examiner* — Adam W Brown
(74) *Attorney, Agent, or Firm* — Procopio, Cory, Hargreaves & Savitch LLP

(57) ABSTRACT

A system for forming a barrier between a lubrication oil region and an air region of a gas turbine engine comprising a lubrication oil return path, a centrifugal oil slinger on a rotating member fixed to a spool of the gas turbine engine, a spiral groove configured to direct lubrication oil toward an oil return path, a labyrinth seal, and a cavity configured to form a non-contacting seal with the spiral groove and the labyrinth seal.

8 Claims, 4 Drawing Sheets

(56) References Cited

U.S. PATENT DOCUMENTS

| | | | | |
|---|---|---|---|---|
| 2003/0131602 | A1 | 7/2003 | Ingistov | |
| 2005/0235651 | A1 | 10/2005 | Morris et al. | |
| 2006/0064988 | A1 | 3/2006 | Ingistov | |
| 2008/0066444 | A1 * | 3/2008 | Cornelius et al. | 60/39.181 |
| 2008/0236170 | A1 | 10/2008 | Weaver et al. | |
| 2009/0008881 | A1 | 1/2009 | Lee et al. | |
| 2010/0178159 | A1 | 7/2010 | Bulgrin et al. | |
| 2011/0007991 | A1 * | 1/2011 | Miller et al. | 384/474 |
| 2011/0217158 | A1 | 9/2011 | Grissino et al. | |

* cited by examiner

GAS TURBINE ENGINE LUBRICATION FLUID BARRIER

TECHNICAL FIELD

The present disclosure generally pertains to a gas turbine engine, and is more particularly directed toward a system and method for forming a barrier between lubrication and air regions of a gas turbine engine.

BACKGROUND

Many gas turbine engines, having high rotational speeds, use labyrinth seals due to their low cost, low friction and long life. A labyrinth seal (or "knife edge" seal) is a type of mechanical seal that, rather than relying on a direct contact seal, instead provides a tortuous path to help prevent leakage. U.S. Pat. No. 6,330,790 to Arora et al. describes a labyrinth seal between a bearing compartment and a compressor compartment.

It is also noteworthy that, in some systems, the labyrinth seal may be buffered with compressed air. In particular, higher pressure air from one part of the gas turbine engine or other source is used. The tapped air is ducted and provided for its pressure, and used as "buffer" air in an area of lower pressure.

The present disclosure is directed toward overcoming one or more of the problems associated with the systems discussed above as well as additional problems discovered by the inventor.

SUMMARY OF THE DISCLOSURE

A gas turbine engine rotating seal including a centrifugal oil slinger section circumscribed on the forward end, a screw seal section having at least one spiral groove configured to direct oil toward the bearing compartment, and then labyrinth seal section having one or more knife edges. According to one embodiment, this seal may interface with a cavity in the gas turbine engine that completes the non-contacting sealing action of the seal, and the cavity may include a lubrication oil return path where oil may be directed away from the seal. According to another embodiment the air/oil barrier may be part of a gas turbine retrofit.

DETAILED DESCRIPTION

Figure 1:
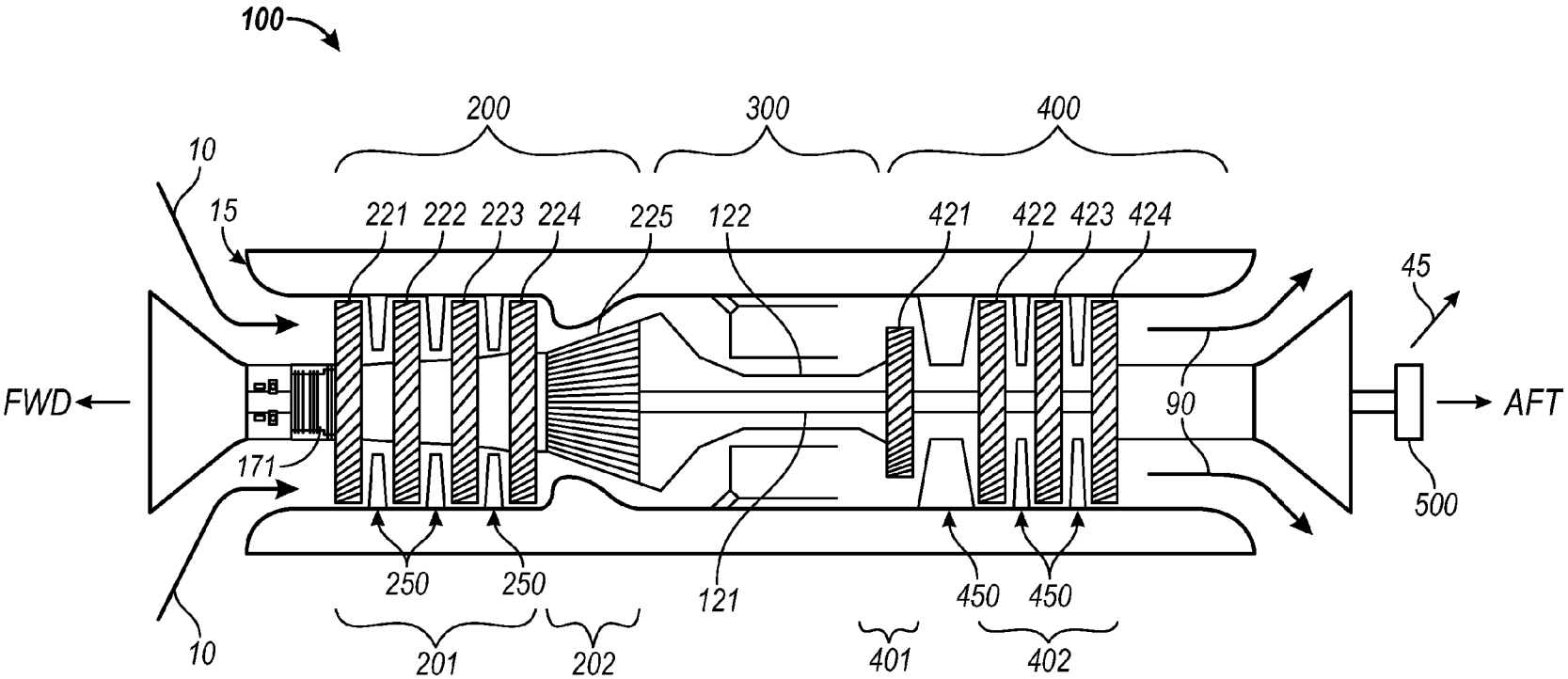
FIG. 1 is a schematic illustration of an exemplary gas turbine engine.

FIG. 1 is a schematic illustration of an exemplary gas turbine engine. A gas turbine engine 100 typically includes a compressor 200, a combustor 300, and a turbine 400. Air 10 enters an inlet 15 and is compressed by the compressor 200. Fuel is added to the compressed air in the combustor 300 and then ignited. Energy 45 is extracted from the combusted fuel/air mixture via the turbine 400, and is typically made usable via an output shaft 500. Exhaust 90 may exit the system or be further processed (e.g., to reduce harmful emissions, and/or to recover heat from the exhaust gas or add it to the compressor outlet air before the air enters the combustion chamber).

The compressor 200 and turbine 400 respectively include one or more rotor assemblies 221-225, 421-424 mechanically coupled to a shaft or drum 121, 122. Referring to rotor assemblies 221-224, 421-424, showing an axial flow rotor assembly, each rotor assembly includes a rotor disk or disks that is circumferentially populated with a plurality of airfoils ("rotor blades"). When installed, the rotor blades associated with one rotor disk are axially separated from the rotor blades associated with an adjacent disk by stationary vanes ("stator vanes" or "stators") 250, or nozzles 450 circumferentially distributed in an annular casing. Rotor assembly 225 shows a centrifugal flow rotor or centrifugal impeller. The impeller's rotating set of vanes gradually compress the air (working gas and thus raise the energy of the working gas. The compressor rotor(s), the turbine rotor(s), and the shaft or drum that connects them are collectively referred to as a "spool".

In the compressor 200, the working fluid is compressed in an axial flow path by the compressor rotors, which are driven by the turbine spool. The air is compressed in numbered "stages", which are associated with each compressor rotor assembly 221, 222, 223, 224, 225. The pressure at an earlier stage in the flow path is lower than at a subsequent stage. Depending on the required final compression ratio (e.g., 10:1, 20:1, etc.), a compressor 200 may have many compression stages. In addition, a compressor 200 may include both a low pressure compressor 201 and a high pressure compressor 202, which may spin at different speeds using different spools.

In the turbine 400, the energized working fluid travels in an axial flow path and "drives" the turbine rotor assemblies 421, 422, 423, 424, which "drive" the turbine spool. Like the compressor 200, turbine 400 may have numbered "stages" that are associated with each turbine rotor assembly 421, 422, 423, 424. Here, however, the pressure at an earlier stage in the flow path is higher than at a subsequent stage. Depending on performance parameters, a turbine 400 may have many stages. In addition, a turbine 400 may include both a high pressure turbine 401 and a low pressure turbine 402, (sometimes referred to as a gas producer turbine, (G.P.) and power turbine, (P.T.) respectively). which may spin at different speeds via different spools.

Figure 2:
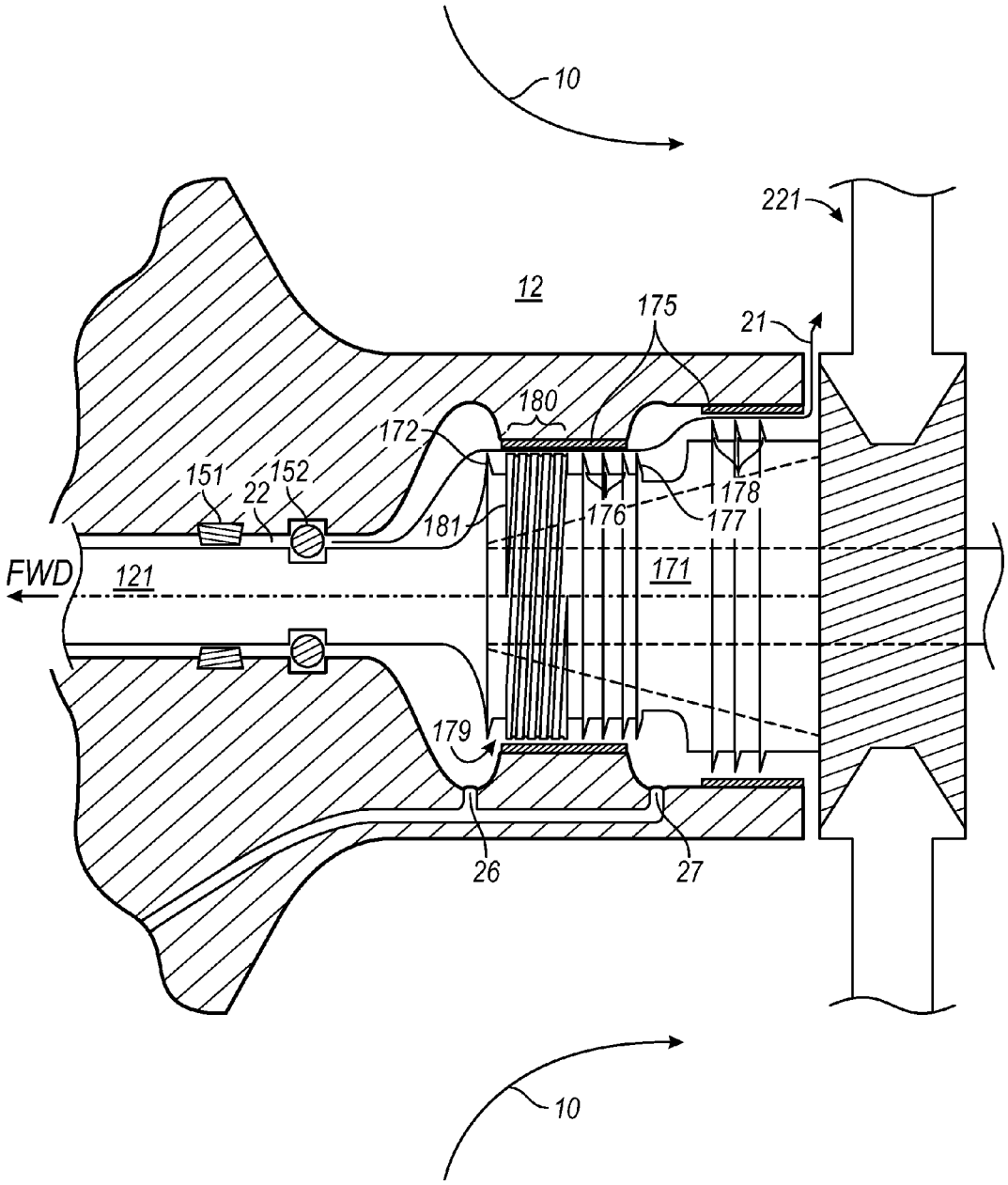
FIG. 2 is a cross-sectional view of a barrier between a lubrication region and an air region according to an exemplary disclosed embodiment.

FIG. 2 is a cross-sectional view of a barrier between a lubrication region 22 and an air region 12 in gas turbine engine 100 according to an exemplary disclosed embodiment. The barrier includes a gas turbine engine rotating seal/barrier ("barrier") 171. Radial (journal) bearings 151 and thrust (axial) bearings 152 are shown housed in a bearing compartment that is bathed in lubricant making up lubrication region 22. Air region 12 is shown here as the annular flow path of air 10 after having entered the inlet 15 and approaching stage one of the compressor rotor assembly 221. Barrier 171 is used to separate/seal lubrication region 22 from an air region 12, which are otherwise joined by the oil leakage path 21. Here, barrier 171 is shown as the rotating member; however, as illustrated, it is understood that barrier 171 is used within the context of a cavity/housing/mating surface ("cavity") 179 having walls opposing barrier 171 that complements the sealing action and forms a non-contacting seal together with barrier 171.

Barrier 171 is illustrated here as a non-contacting rotating seal that couples to low pressure shaft 121. Barrier 171 may be formed of a durable, hard material, such as 4340 alloy steel. Barrier 171 may be embodied as a sleeve that attached directly to shaft 121 or to an intermediate coupling to shaft 121 (e.g., the forward cone, or the stage 1 compressor rotor assembly 221). Alternately, barrier 170 may be machined directly into a functional component such as shaft 121, forward cone, or some other load bearing rotational member.

Where material barrier 171 is made from a durable material, barrier 171 may have a interface with an abradable material or wear surface ("wear pad") 175. In this way, wear on barrier 171, being of more durable composition, is mitigated. Wear pad(s) 175 may be fixed to the corresponding surface(s) in cavity 179 where barrier 171 is installed. Wear pads 175 may be integrated as part of the bore itself or may be part of a removable/replaceable unit. The abradable material may be formed of a material somewhat softer than that of barrier 171. For example, abradable material 175 may include a steel backing with a softer material coating, such as bronze (a.k.a. Babbitt material). In addition, rather than covering the entire cavity 179, wear pad 175 may be limited to just those portions where there is a greater likelihood of inadvertent contact between barrier 171 and cavity 179.

According to one embodiment, barrier 171 may form a composite seal, including a plurality of sections of seals/barriers. Sections of labyrinth seals, metallic brush seals, ceramic brush seals, or carbon seals may be used in combination. Buffer air may be applied to one or more sections. Also, these separate seals may have different diameters, and thus, where integrated into a single composite seal, may be formed in a stepped configuration as illustrated.

According to one embodiment, barrier 171 may include a spiral groove circumscribed on the rotating member (forming screw seal section 180). It is understood that the spiral groove may be formed by removing material from or adding material to a base material. Screw seal section 180 may interface with a corresponding abradable material 175 in cavity 179 to mitigate wear. In operation, oil that gets between the mating surface of cavity 179 and the spiral groove is pushed back toward the oil sump by the screw thread as it is turning. According to one embodiment, a spiral groove may be formed into single, double or multiple threads.

Screw seal section 180 may be configured such that buffer air is not required or less buffer air is needed than otherwise would be. By coordinating the direction of screw thread with the rotation of rotating member the spiral groove may have its own pumping effect. In addition, performance of screw seal section 180 may be adjusted by varying the spiral groove's depth, gap, pitch, and number of turns. As applied here, screw seal 180 may take advantage of the gas turbine engine's slower speed during transition periods. In particular, at these lower speeds the screw action may mechanically or pneumatically redirect lubrication oil back toward oil slinger 172, and ultimately routed back to the lubrication system.

According to one embodiment, barrier 171 may include a rotating seal including one or more oil slinger sections 172, 177, one or more screw seal sections 180, and one or more labyrinth seal sections 176, 178. A centrifugal oil slinger ("oil slinger") 172, 177 is a type of mechanical device that uses rotational motion to create a centrifugal force directing fluid in a desired direction. As illustrated, centrifugal oil slinger section 172 is circumscribed on the forward end of rotating barrier 171, and configured to redirect lubrication oil away from barrier 171. Furthermore, the bearing lubricant oil is directed outwardly away from the lubricant migration path 21. Additionally, as illustrated, oil slinger sections 172, 177 may be used in conjunction with one or more lubrication oil return paths (e.g., drains) 26, 27 configured to provide for lubricant to return to the lubrication compartment and/or to an oil sump (not shown).

As illustrated, in this embodiment, barrier 171 includes screw seal section 180. The spiral groove 181 circumscribed on the rotating member may be axially positioned aft (relative to the forward (FWD) direction indicated in the figure) of the first centrifugal oil slinger section 172. Screw seal section 180 may interface with a corresponding abradable material 175 in cavity 179 to mitigate wear. Screw seal section 180 may be configured to direct lubrication oil toward the forward end of barrier 171, for instance, by coordinating the direction of spiral with the rotation direction of barrier 171. Accordingly, screw seal section 180 may be configured such that buffer air is not required.

Additionally, in this embodiment, barrier 171 may include one or more labyrinth seal sections 176, 178. The first labyrinth seal section 176 may be circumscribed on the rotating member and axially positioned aft of the screw seal section 180. As illustrated, each labyrinth seal section 176, 178 may include one or more "knife edges". It is understood that each "knife edge" is generally described as a protruding annular obstruction to the oil leakage path 21, but is not limited in its profile shape. Also, as shown, labyrinth seal sections 176, 178 may operate without buffer air. Alternately, buffer air may be used in conjunction with one or more of the labyrinth seal sections 176, 178.

According to one embodiment, barrier ("new barrier") 171 may be part of a gas turbine engine retrofit. In particular, new barrier 171 may be constructed to mate with the bore dimensions of a preexisting barrier's cavity 179 for subsequent replacement. In addition, screw seal section 180 may be limited to an axial length matching that of a preexisting wear pad 175. New barrier 171 may be constructed with an equivalent or similar material as the preexisting barrier. Since both the preexisting barrier and new barrier 171 mount to the gas turbine engine 100 in the same manner and rotate with the spool, they may be interchangeable. As such, the old barrier may be removed and replaced with new barrier 171. In addition, where used, the buffer air ports may be capped (all or some portion thereof), and the associated tubing/ducting removed. This retrofit may advantageously be done during routine maintenance, overhaul, or during inspection of wear pads 175, for example.

Figure 3:
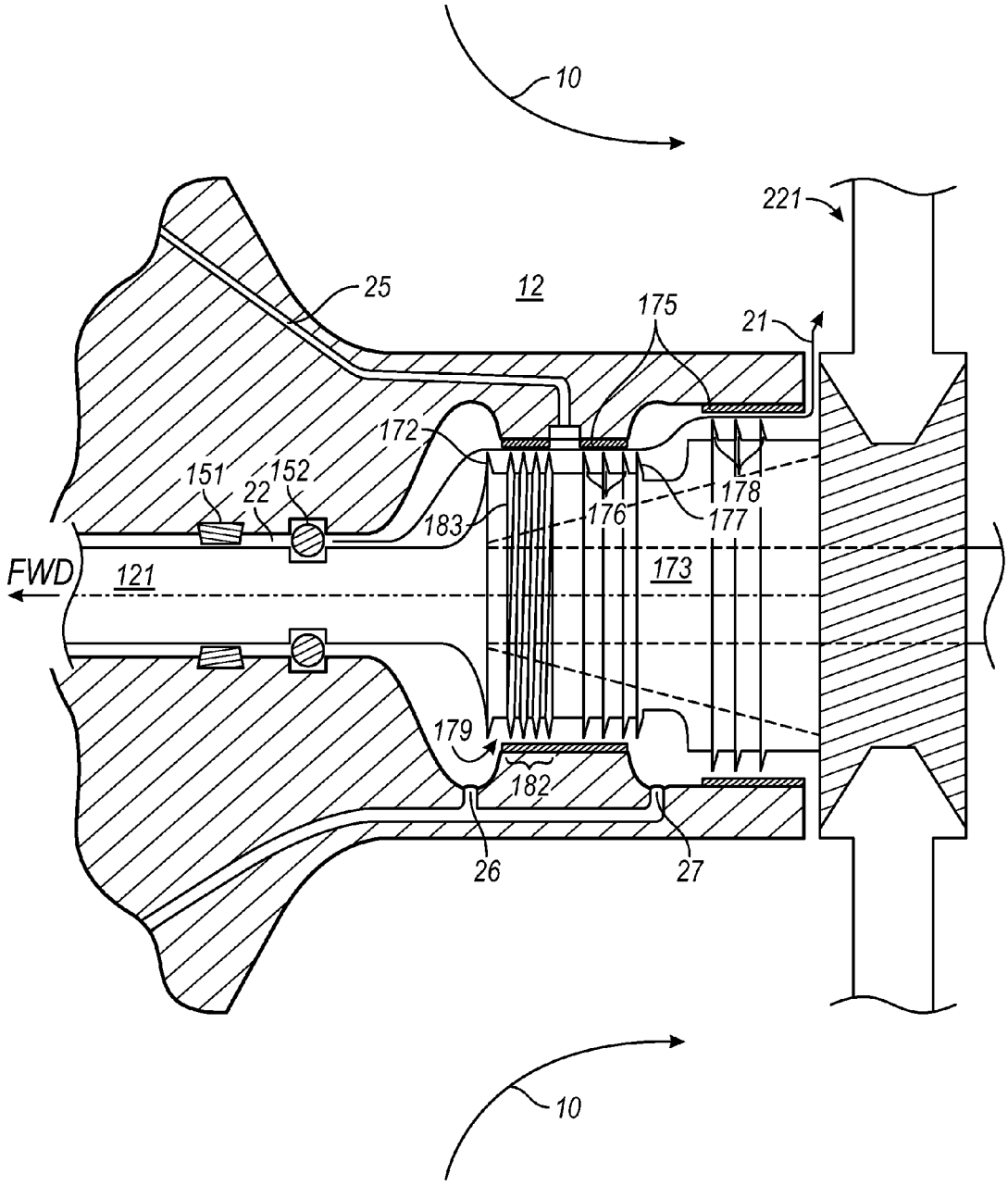
FIG. 3 is a cross-sectional view of a barrier between a lubrication region and an air region according to an exemplary disclosed embodiment.
Figure 4:
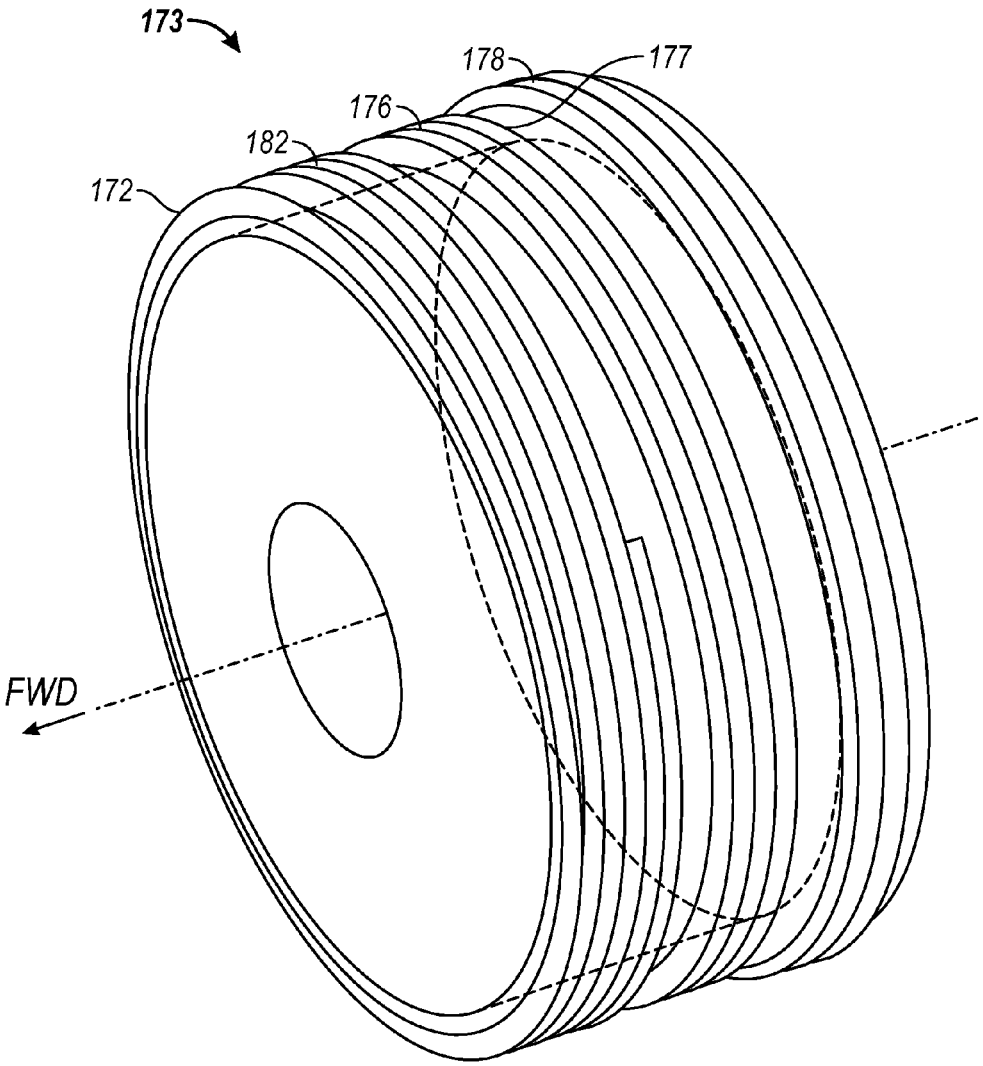
FIG. 4 shows a perspective view of an air/oil seal according to an exemplary disclosed embodiment.

FIG. 3 is a radial cross-sectional view of a barrier between a lubrication region 22 and an air region 12 in a gas turbine engine 100 according to an exemplary disclosed embodiment. Here, the barrier includes gas turbine engine rotating seal/barrier ("barrier") 173 that is similar to barrier 171, except screw seal section 180 is replaced with a hybrid labyrinth-screw seal section 182, and here buffer air 25 is also used. As with the screw seal section 180 above, barrier 173, and thus hybrid labyrinth-screw seal section 182, may be machined directly into a functional/load bearing component. Alternatively barriers 171, 173, may be part of a sleeve as shown in FIG. 4. Whether integrated into a load bearing component or a sleeve, hybrid labyrinth-screw seal 182 may interface with a corresponding abradable material 175 to mitigate wear.

The spiral groove of hybrid labyrinth-screw seal section 182 combines the features of both a screw seal and a labyrinth seal, thus providing redirection of lubricant leakage and a tortuous leak flow path. In particular, hybrid labyrinth-screw seal section 182 includes a spiral groove 183 that may be formed by a continuous spiral "knife edge". Similar to the labyrinth seal knife edge, the spiral groove knife edge is not limited in its profile shape. Likewise the depth of the spiral groove knife edge may be comparable to the height of the labyrinth seal knife edge. For example, the depth of the hybrid labyrinth-screw seal may be greater than half the height of the labyrinth seal knife edge. Similarly, the thread/tooth/knife edge depth of hybrid labyrinth-screw seal section 182 may generally differ from the groove depth of screw seal section 180 by more than a 10:1 ratio. According to one embodiment, labyrinth-screw teeth may be formed into single, double or multi-threads. Additionally, the thread/tooth/knife edges of hybrid labyrinth-screw seal section 182 may be customized in depth, gap, pitch, and number of turns based on operating conditions and to vary the balance of return oil flow/air flow versus buffer air pressure.

According to one embodiment a buffer air may be employed. Here, buffer air may be tapped from a higher stage of the compressor 200, and ported to the of hybrid labyrinth-screw seal section 182, as a buffer air source 25. Buffer air source 25 may enter cavity 179 along oil leakage path 21 and opposite lubrication oil region 22. In particular, buffer air may be ported between hybrid labyrinth-screw seal section 182 and the first labyrinth seal section 176. Here, an adequate air-to-oil differential pressure is created at hybrid labyrinth-screw seal section 182 by buffer air source 25, however, labyrinth seal section 176 may increases back pressure for the hybrid labyrinth-screw seal section 182 interface, and may also compensate for any low pressure effects ("lift") caused by the compressor air stream. Additionally, in some applications it may be desirable to put one or more labyrinth teeth between the oil cavity and the buffer air supply.

As with barrier 171, barrier (again, "new barrier") 173 may be part of a gas turbine engine retrofit. In particular, new barrier 173 may be constructed to mate with the bore dimensions of a preexisting barrier's cavity 179 for subsequent replacement. In addition, hybrid labyrinth-screw seal section 182 may be limited to an axial length matching that of a preexisting wear pad 175. New barrier 173 may be constructed with an equivalent or similar material as the preexisting barrier. Since both the preexisting barrier and new barrier 173 mount to the gas turbine engine 100 in the same manner and rotate with the spool, they may be interchangeable. As such, the old preexisting barrier may be removed and replaced with new barrier 171. Here, where buffer air was used in the preexisting barrier, the buffer air may continue to be used as a buffer air source 25 for hybrid labyrinth-screw seal section 182. This retrofit may advantageously be done during routine maintenance, overhaul, or during inspection of wear pads 175, for example. Alternatively, buffer may be used during low speeds and then shut off at higher speeds.

While the present disclosure is directed to the lubrication oil/air barrier forward of a gas turbine engine compressor, it is understood that the barrier described herein is not limited to this location alone. In particular, the barriers described herein may also be used in other bearing locations or in between lubricant regions and air regions throughout the gas turbine. This is especially the case where there exists a pressure differential across the barrier where a lower pressure exists opposite the oil regions.

INDUSTRIAL APPLICABILITY

Within the gas turbine engine 100, various, distinct fluid flows exist. For example, distinct fluids flow can exist in: the annular air/working fluid stream, the various cooling systems, the pressure/buffer systems, and the lubrication systems. While some mixing of fluid flows may be acceptable, it may be also desirable to segregate certain regions from others. For example, lubrication flow should generally be limited to the lubrication system. In particular, in the forward compressor bearing (or No. 1 bearing assembly), without barriers or sealing measures, lubrication oil might migrate into the compressor spool and into the air stream, leading to fouling and increased maintenance.

Normal operating speeds of a gas turbine engine may be in excess of 10,000 RPM. This may create challenges and limits the options for segregating fluid flows and sealing different compartments from each other. In particular, specialized high speed seals may be used. Buffered labyrinth seals can be generally effective at sealing lubrication oil out of the air regions.

At times it may be advantageous to tap higher pressure air from one stage for use at another location in the engine, where the tapped air may be then ducted and provided for its pressure, its temperature, or a combination of both. With buffered labyrinth seals, higher pressure air may be used as "buffer" air in an area of lower pressure.

Although gas turbine engines are highly efficient, tapping working fluid that has had energy added (e.g., compressed air) for buffering may introduce losses to the engine's overall performance and efficiency. In addition, performance drawbacks may exist under certain operating conditions. In particular, during transition periods where the gas turbine speeds are significantly diminished, buffer air pressure may be significantly diminished as well (e.g., due to reduced compressor rotation speed). This may then lead to underperformance of the labyrinth seal(s) during these periods. For example, in the range of 1-25% of operating speed, buffer air pressure may be such that knife seals do not seal as effectively, and may be comparable to unbuffered knife seals.

As compared to aero gas turbine applications, in stationary or industrial gas turbine applications, there are fewer such transition periods where the turbine runs for extended periods (e.g., week, month, year duty cycles) at very high speeds (e.g., in excess of 10,000 RPM). Nonetheless, even in these industrial applications, transition periods may exist wherein buffered seal performance is reduced and the above drawbacks exists. For example, during turbine start up, shut down, and post operation lubrication cycling ("post-op lube"), the compressor speed may be at a sufficiently low RPM to result in low buffer air pressure, and thus reduced seal performance. Moreover, given that this is a transient condition with only limited frequency, it may go unnoticed or misdiagnosed, leading to premature seal replacement or over-design of seals in the first instance.

In addition, observations and experimentation has shown that oil sometimes leaks past current seals when the rotor is turning, but very seldom gets past the seal when the rotor is stationary —even though oil is still being fed to the bearings. This being the case, the screw seal sections described above may keep oil in the sump as the rotor is turning, possible reducing concern of oil leaking past the seal while the rotor is stationary.

As applied here, the screw seal sections take advantage of the gas turbine engine's slower speed during transition periods. At these lower speeds the screw action can mechanically or pneumatically redirect lubrication oil back toward the oil slinger, and ultimately back to the lubrication system. Thus, in operation, oil that gets between the spiral groove and the cavity mating surface is pushed back into the oil sump by the screw action as it is turning at reduced speeds.

The disclosed turbine engine embodiments may be suited for any number of industrial applications, such as, but not limited to, various aspects of the oil and natural gas industry (including include transmission, gathering, storage, withdrawal, and lifting of oil and natural gas.), power generation industry, aerospace and transportation industry.

In addition to the turbine engine and air/oil seal embodiments discussed above, an associated method for servicing a turbine engine in the field is also disclosed. An existing barrier may be removed and replaced with a new barrier. In addition, the buffer air ports may be capped and their associated tubing/ducting removed. Alternately, if buffer air is to continue to be used, buffer air 25 ports or conduit may be left intact. This retrofit may advantageously be done during routine maintenance, or during inspection of wear pads 175, for example.

The preceding detailed description is merely exemplary in nature and is not intended to limit the invention or the application and uses of the invention. The described embodiments are not limited to use in conjunction with a particular type of gas turbine engine. Hence, although the present embodiments are, for convenience of explanation, depicted and described as being implemented in a two-spool gas turbine engine, it will be appreciated that it can be implemented in various other types of turbines, and in various other systems and environments. (Also mentioned somewhere the gas turbine engine may be powered by a variety of different fuels.) Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A method for retrofitting a gas turbine engine, the method comprising:

removing a preexisting gas turbine engine rotating seal;

installing a gas turbine engine rotating seal having a forward end and aft end, relative to its axis of rotation, the gas turbine engine rotating seal comprising:

a first centrifugal oil slinger section circumscribed on the forward end of a rotating member and configured to redirect lubrication oil away from the rotating member, a screw seal section including at least one spiral groove circumscribed on the rotating member and axially positioned aft of the first centrifugal oil slinger section and configured to direct lubrication oil toward the forward end of the rotating member, and, a first labyrinth seal section including one or more knife edges, the first labyrinth seal circumscribed on the rotating member and axially positioned aft of the screw seal section;

capping a preexisting port configured to provide buffer air to the preexisting rotating seal; and removing air delivery equipment configured to deliver buffer air to the preexisting port.

2. The method of claim 1, wherein the screw seal section comprises a hybrid labyrinth-screw seal.

3. The method of claim 2, wherein the hybrid labyrinth-screw seal has a spiral groove with a depth greater than half the height of the one or more knife edges of the first labyrinth seal section.

4. The method of claim 1, wherein the gas turbine engine rotating seal further comprises a second centrifugal oil slinger section circumscribed on the rotating member and positioned aft of the first labyrinth seal section and configured to redirect lubrication oil away from the rotating member.

5. The method of claim 1, wherein the gas turbine engine rotating seal further comprises a second labyrinth seal section including one or more knife edges, the second labyrinth seal circumscribed on the rotating member and axially positioned aft of the second centrifugal oil slinger section.

6. The method of claim 5, wherein the first labyrinth seal section is defined by a first diameter of the rotating member and the second labyrinth seal section is defined by a second diameter of the rotating member, the first diameter different from the second diameter.

7. The method of claim 5, wherein the gas turbine engine rotating seal is installed opposing a cavity of the gas turbine engine, the cavity having an abradable material configured to interface with the first labyrinth seal and the second labyrinth seal as a wear surface.

8. The method of claim 1, wherein the rotating member comprises a forward cone of the gas turbine engine.

* * * * *